US005111603A

United States Patent [19]

Knowlton et al.

[11] Patent Number: 5,111,603

[45] Date of Patent: May 12, 1992

[54] COUPLING FOR A SNOW PLOW

[76] Inventors: Leland P. Knowlton, 80 Forest St., Worcester, Mass. 01609; Kirk A. Knowlton, P.O. Box 742, Worcester, Mass. 01602

[21] Appl. No.: 574,660

[22] Filed: Aug. 29, 1990

[51] Int. Cl.[5] ..... E01H 5/04

[52] U.S. Cl. ..... 37/231; 172/272; 280/460.1; E01H/5/04

[58] Field of Search ..... 37/98, 103, 231, 235; 172/272, 274, 275, 817; 414/723; 280/460.1, 507, 514; 403/315, 316, 319

[56] References Cited

U.S. PATENT DOCUMENTS

| | | | |
|---|---|---|---|
| 2,252,691 | 8/1941 | Arnot | 280/460.1 |
| 2,577,145 | 12/1951 | Nearing et al. | 37/231 X |
| 3,404,901 | 10/1968 | Rau | 172/272 |
| 3,410,008 | 11/1968 | Standfuss | 37/231 |
| 3,987,562 | 10/1976 | Deen et al. | 37/231 |
| 4,176,727 | 12/1979 | Perin | 172/272 X |
| 4,241,935 | 12/1980 | Vollmer et al. | 172/272 |
| 4,619,060 | 10/1986 | Knowlton | 37/231 |
| 4,813,698 | 3/1989 | Grinwald | 280/460.1 |

*Primary Examiner*—Randolph A. Reese
*Assistant Examiner*—Spencer Warnick
*Attorney, Agent, or Firm*—Blodgett & Blodgett

[57] ABSTRACT

A coupling for a plow which includes push beam which is attachable to the front of a vehicle and a supporting frame which is attachable to the back side of the plow. The push beam has at least one forwardly extending arm at each end of the beam and a transversely extending connecting pin for each arm. The supporting frame has a pair of rearwardly extending arms. The coupling also includes a slotted mounting tab which is attached to the rearward end of each rearwardly extending arm for receiving the pins and a retaining rod which is removably attached to the tabs for blocking the downward movement of the forwardly-extending arms and preventing the pins from moving out of the slots in the tabs.

6 Claims, 4 Drawing Sheets

FIG. 3
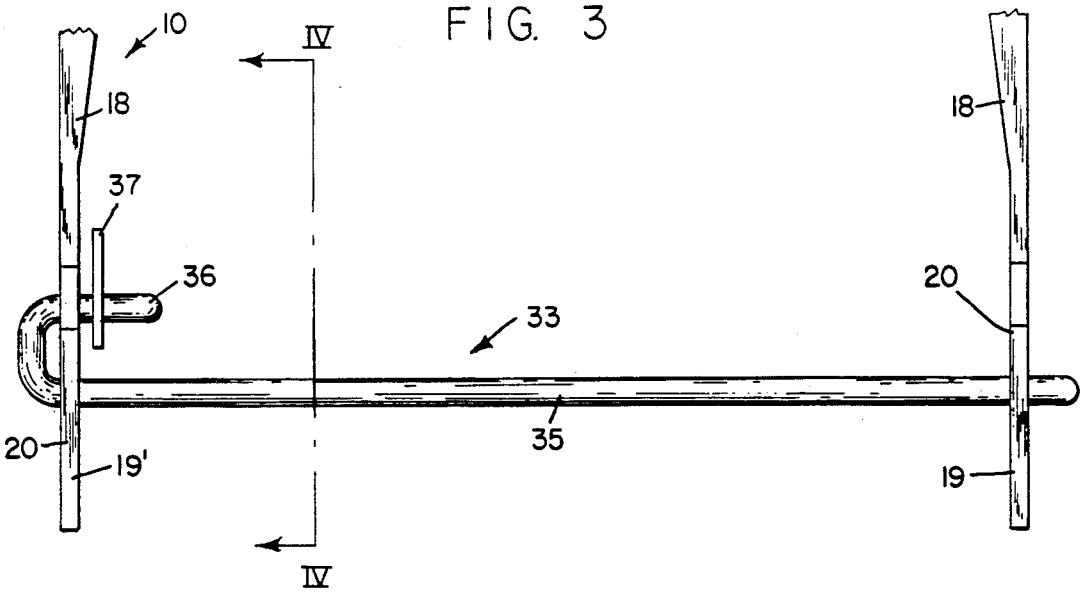
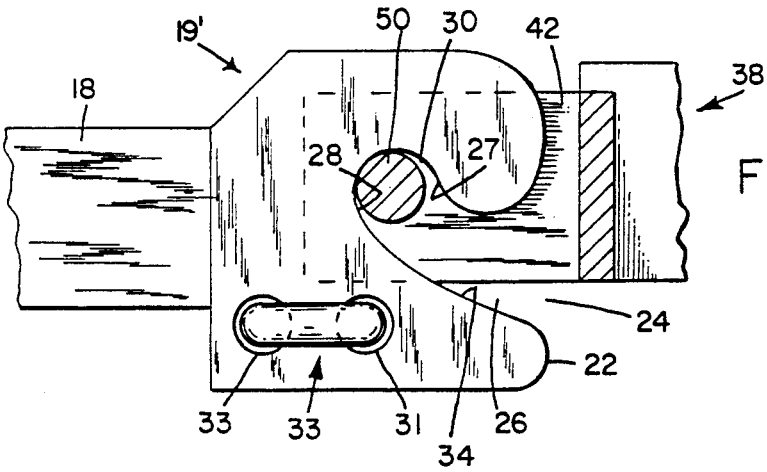
FIG. 5
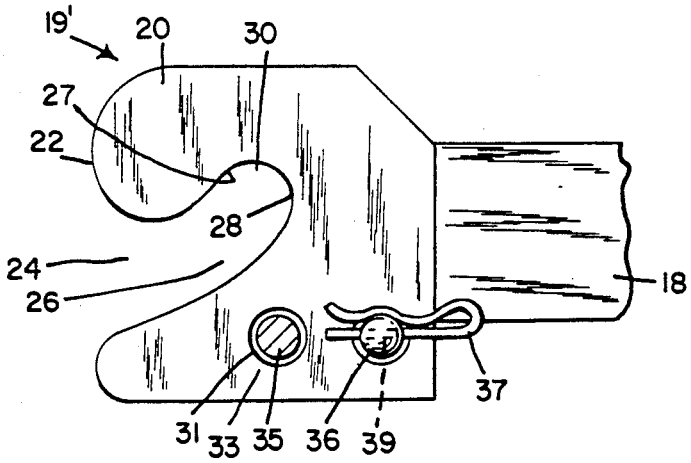
FIG. 4

FIG. 6
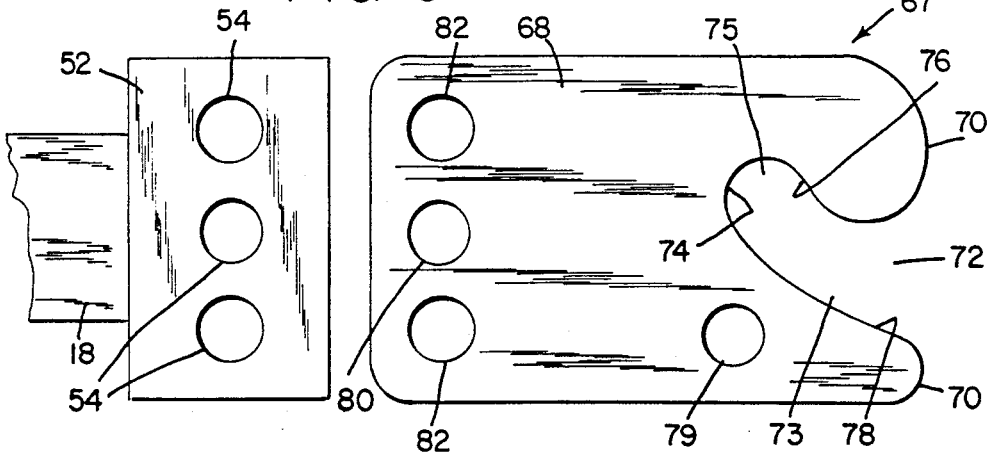
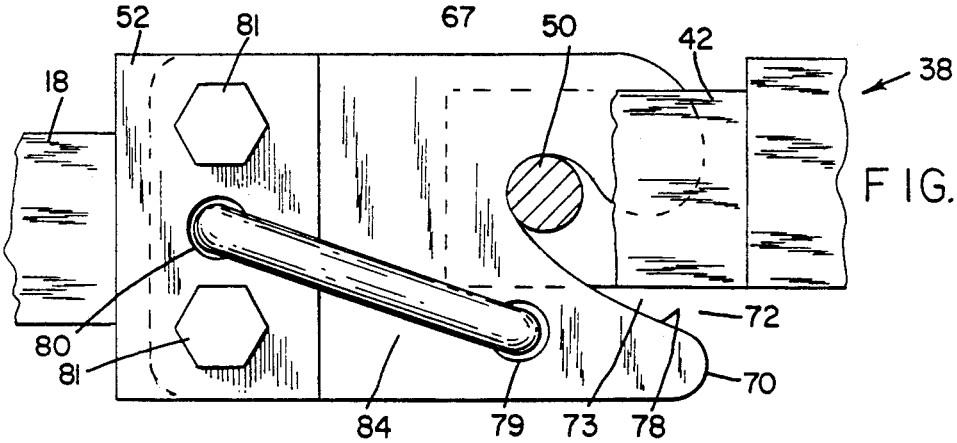
FIG. 7
FIG. 8
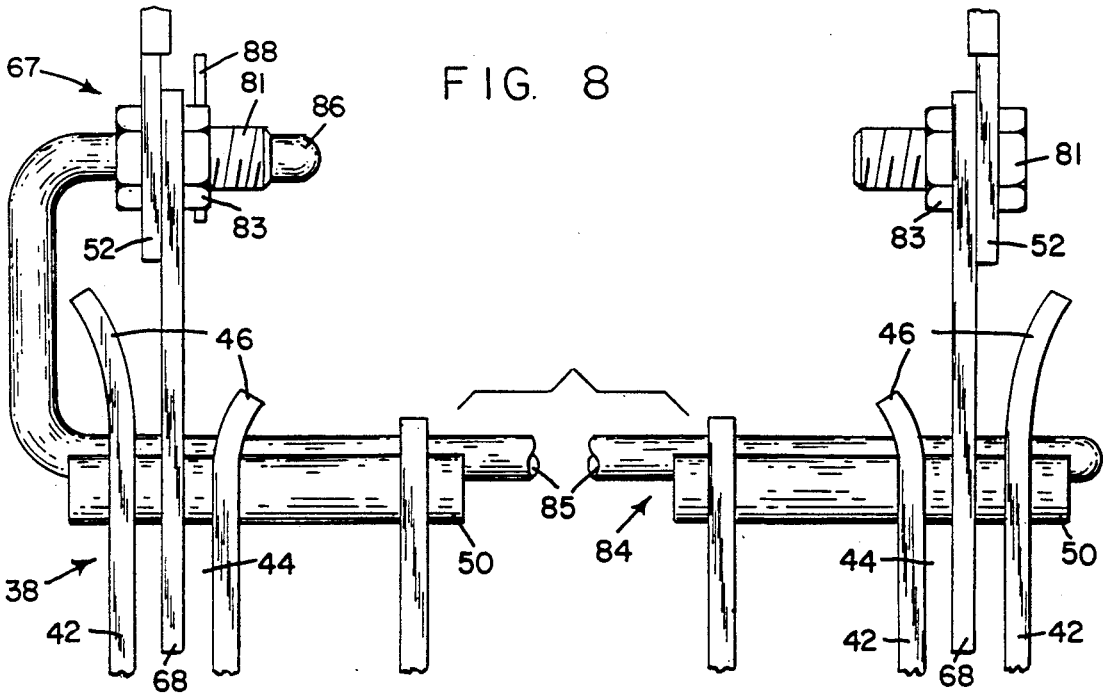

COUPLING FOR A SNOW PLOW

BACKGROUND OF THE INVENTION

The present invention relates generally to coupling means for a snow plow and, more specifically to automatic coupling and uncoupling means.

A conventional snow plow includes framework which is fixed to the back of the plow. The framework is adapted to be connected to an "A-frame" which is provided with hydraulic actuating means for angling the plow. The "A-frame" is also provided with coupling means for coupling with complimentary coupling means of framework which is attached to the front of the plow vehicle. This latter framework is generally referred to as a "push beam" and includes a pair of spaced guides for receiving a pair of spaced tabs which extend rearwardly from the "A-frame". Each tab has a plurality of apertures and is adapted to fit into one of the guides of the "push beam". A retractable connecting pin is associated with each guide. The pin extends laterally through apertures in the guide and through one of the apertures of the tab, when the tab is positioned within the guide, so that one of the apertures of the tab is axially aligned with the apertures of the guide.

During periods when the plow is not being used, it is disconnected from the vehicle and stored in a location where the vehicle can be driven up to the "A-frame" of the plow for recoupling. Normally, the "A-frame" is mounted on blocks at a height which enables the tabs to be at the same height as the guides in the "push beam". The connecting pins are pulled out of the guides and the vehicle is advanced toward the "A-frame", so that the tabs enter the guides. Most of the time, the apertures in the guides are misaligned within the guides by means of lift chains which are connected to a hydraulically operated lever in the vehicle. After the apertures in the guides are aligned with corresponding apertures in the tabs, the connecting pins are reinserted into the guides and through the tabs. The entire operation of coupling the plow to the plow vehicle is awkward and time-consuming, particularly if the entire operation is performed by a single individual. First of all, it is extremely difficult for an individual to advance the vehicle toward the "A-frame", so that the tabs are horizontally aligned with the guides. Very often, several attempts must be made before the tabs are generally aligned with the guides, so that they can be advanced into the guides. The individual must make several trips into and out of the vehicle. When the operation is performed by two individuals, one individual can stay in the vehicle while the other individual attempts to direct the movement progress of the vehicle. Even with two individuals, several reciprocations of the vehicle must be made before the tabs are aligned within the guides. Thereafter, the "A-frame" must be manipulated vertically to properly align the apertures of the guide with corresponding apertures in the tabs. Under ideal weather conditions, the entire coupling operation is difficult enough. However, most of the time weather conditions are substantially less than ideal. In most cases, snow plowing begins in the early morning hours when it is dark. There is always a certain degree of emergency to get started and coupling under less than ideal conditions can be very frustrating to the operator.

After plowing has been completed, the task of uncoupling the plow from the vehicle is just as difficult as the task of coupling the plow to the vehicle. After the plow has been lowered to the mounting blocks, the connecting pins are removed from the tabs. If the plow frame is not at the precise vertical position, there is downward or upward pressure on the pins which causes them to bind and makes it difficult, if not impossible, to pull out.

An automatic coupling for snow plows has been developed and shown in U.S. Pat. No. 4,619,060 to Leland P. Knowlton, one of the inventors of the present application. Under ordinary operating conditions, the device which is shown in the Knowlton functions exactly as intended. The coupling mechanism which is disclosed in this patent enables the plow to be coupled and uncoupled automatically. However, under certain unusual or extreme conditions, it is possible for unwanted uncoupling to occur. An example of such unusual circumstances are plowing on an uneven surface as for example, having one wheel on the sidewalk and the other wheel on the road. Another example of an unusual circumstance is misalignment of the coupling plates due to damage to the supporting frame for the plow.

The principle object of the present invention is to provide a plow coupling which enables a plow to be coupled and uncoupled automatically and which prevents uncoupling in unusual or extreme circumstances.

Another object of this invention is the provision of a plow coupling which enables a plow to be coupled and uncoupled automatically and which includes safety retaining means which positively prevent accidental uncoupling of the plow during a plowing operation.

A further object of the present invention is the provision of an automatic coupling and uncoupling mechanism for a snow plow with a hand actuated retaining mechanism which prevents accidental uncoupling of the plow during plowing and which is simple in construction and easy to operate.

With these and other objects in view, as will be apparent to those skilled in the art, the invention resides in the combination of parts set forth in the specification and covered by the claims appended hereto.

SUMMARY OF THE INVENTION

In general, the invention consists of a push beam which is attached to the front of a plow pushing vehicle. A supporting frame which is attachable to the back side of a plow. A pair of mounting tabs which are attached to the ends of the arms of the supporting frame and removably attached retaining means to prevent uncoupling of the plow. Each mounting tab has a slot and an opening to the slot for receiving a connecting pin which forms part of the push beam. This slot has a forward edge which is engaged by the pin as the plow is pushed forwardly. The retaining element, when attached, extends below the bottom edges of the arms which support the connecting pins and is engaged by the bottom edges of the arms during rearward movement of the pins along the slots of the mounting tabs towards the opening to the slots, thereby preventing the pins from reaching the opening.

BRIEF DESCRIPTION OF THE DRAWINGS

The character of the invention, however, may be best understood in reference to one of its structural forms, as illustrated by the accompanying drawings, in which:

FIG. 3 is a top plan view of the plow coupling with portions of the push beam being broken away, FIG. 4 is a vertical cross-sectional view looking in the direction of arrow IV—IV of FIG. 3 and looking in the direction of the arrows, FIG. 5 is a fragmentary cross-sectional view showing a mounting tab of the present invention coupled to the push beam when the plow is being pushed forwardly by the vehicle, FIG. 6 shows a first modification of the invention in which the mounting tabs of the present invention are separate elements which are adapted to be mounted to a conventional plow frame, FIG. 7 is a fragmentary cross-sectional view showing the mounting tab of FIG. 6 coupled to the push beam when the plow is being pushed forwardly by the vehicle, FIG. 8 is a top plan view showing a pair of modified mounting plow coupling tabs of FIG. 6 mounted to the plow frame and coupled to the push beam.

DETAILED DESCRIPTION OF THE INVENTION

Figure 1:
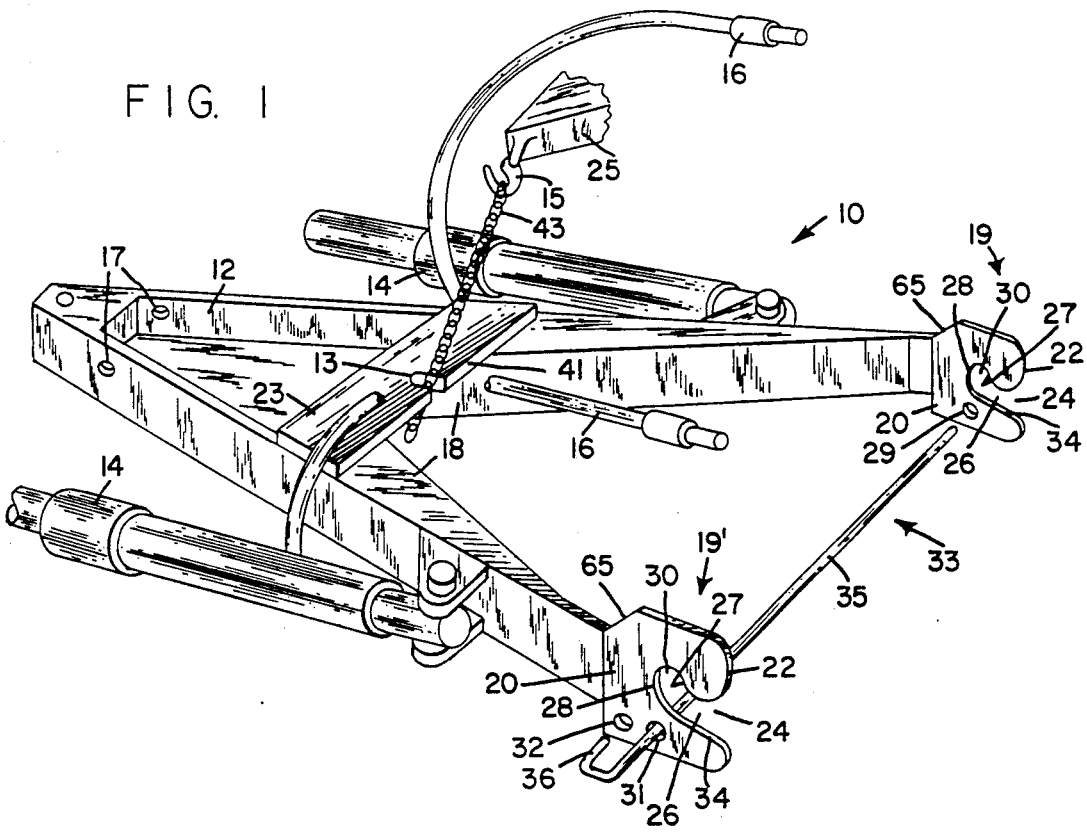
FIG. 1 is a perspective view of a plow coupling embodying the principles of the present invention.
Figure 2:
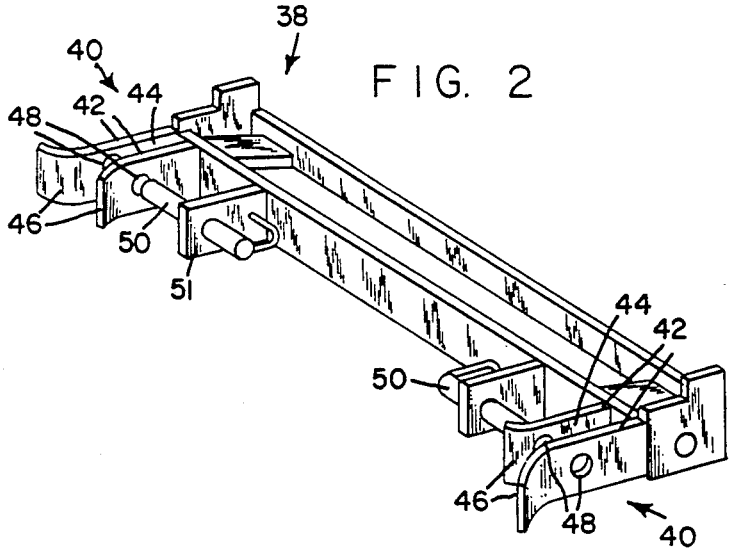
FIG. 2 is a perspective view of a push beam which is attachable to the plow vehicle and which is adapted to be coupled with the coupling means which is illustrated in FIG. 1.

Referring first to FIGS. 1 and 2, the plow coupling means of the present invention is generally indicated by the reference numeral 10 and includes a supporting frame 12 which is adapted to be mounted to the back side of a plow. The supporting frame 12 is of conventional A-frame construction and it includes a pair of hydraulic cylinders 14 which are adapted to be connected to the hydraulic system of a plow vehicle by means of hydraulic lines 16 for controlling the horizontal plow angle. The forward end of the supporting frame is provided with apertures 17 for receiving a lifting chain. The lifting chain (not shown) is connected to a hook 15 of a hydraulically controlled actuating lever or "headgear" 25 for lifting and lowering the plow. The supporting frame 12 also includes a pair of rearwardly-extending spaced arms 18. The rear end of each arm 18 is connected to a mounting tab. The mounting tabs are generally indicated by the reference numerals 19 and 19', see also FIGS. 3-5.

The supporting frame 12 also includes a cross brace 23 which is fixed to the top of the arms 18 and has a notch 13 in its rear edge 41. The notch 13 is adapted to receive the end of a safety chain 43. The opposite end of the safety chain 43 fits into an appropriate notch (not shown) in the head gear 25. The primary purpose of the safety chain is to prevent the frame 12 and plow from falling to the ground in the event of a failure of the plow lifting mechanism or the lifting chain. The safety chain can also be connected to the hook 15 for adjusting the height of the supporting frame 12 when setting the frame on supporting blocks.

Each of the mounting tabs 19 and 19' comprises a vertical flat plate 20. The plate 20 has an opening 24 in a rear edge 22 of the plate. A slot 26 extends forwardly and upwardly from the opening 24 and terminates in a forward edge 28. At the forward edge 28, the slot 26 has an upwardly curving portion 30 which has a rearward edge 27. Each of the tabs 19 and 19' has an aperture 31 which is below the slot 26. The aperture 31 of the tab 19' is horizontally aligned with the aperture 31 in the tab 19. Each of the tabs 19' and 19 have a second aperture 32 which is below the slot 26 and forward of the aperture 31. A retaining element, generally indicated by the reference numeral 33, is removably mounted to the tabs 19 and 19'. The retaining element 33 comprises an elongated rod 35 which has a 180° bend at one end to form a relatively short projecting element 36 which is substantially parallel with the main portion of the elongated rod 35. The element 36 has an aperture 39, see FIG. 4, for receiving a hitch pin retainer 37. When the elongated rod 35 is inserted through the apertures 31 of the tabs 19' and 19, the projecting element 36 extends through the forward aperture 32 of either the tab 19' or the tab 19 (depending upon the direction of insertion of the rod 35) for a purpose to be described in greater detail hereinbelow.

Referring to FIG. 2, there is shown a conventional push beam, generally indicated by the reference numeral 38, which is adapted to be mounted to the front of the plow vehicle. The push beam 38 extends horizontally and includes at each end thereof, a coupling element, generally indicated by the reference numeral 40. Each coupling element 40 comprises a pair of forwardly-extending spaced arms 42 which terminate in flared ends 46. The arms 42 define therebetween a guide slot 44. Each arm 42 has an aperture 48 and the apertures 48 are axially aligned. A connecting pin 50 is slidably mounted on a bracket 51 for axial movement through the apertures 48, so that it extends across the opening 44. The coupling elements 40 are adapted to receive the mounting tabs 19 and 19' for coupling the plow to the plow vehicle.

The connecting pins 50 are mounted for axial movement to enable the push beam to be connected to a conventional plow frame. However, the pins 50 can be fixed when used with the coupling means of the present invention.

The operation and advantages of the present invention will now be readily understood in view of the above description.

Referring to FIGS. 1 and 2, the frame 12 is mounted to the rear side of the plow and the push beam 38 is mounted to the front of the plow vehicle. When the plow is not being used, it is stored in a location which is accessible to the plow vehicle. The plow is normally mounted on blocks so that the mounting tabs 19 and 19' are elevated and extend above the ground a distance which is approximately equal to the height of the guide slots 44. The plow vehicle is driven toward the mounting tabs 19 and 19' so that the tabs enter the guide slots 44. The pins 50 are positioned so that they are located in the apertures 48 and extend across the slots 44. The flared ends 46 cam the mounting tabs 19 and 19' into the guide slots 44 so that the tabs do not have to be perfectly aligned with the guide slots in the horizontal direction as the plow vehicle approaches the supporting frame of the plow. As each mounting tab enters its respective guide slot 44, the connecting pin 50 enters the opening 24. The mouth of the opening 24 is considerably larger than the diameter of the connecting pin 50 and converges toward the slot 26. Also, the lips of the mouth of opening 24 are rounded. This compensates for a certain degree of vertical misalignment between the connecting pin 50 and the slot 26. Continued forward motion of the plow vehicle causes each pin 50 to advance along its corresponding slot 26 until it reaches the forward edge 28. The elongated rod 35 of the retaining element 33 is inserted through the aperture 31 of the tab 19' and through the aperture 29 of the tab 19 while the projecting portion 36 extends through the aperture 32 of the tab 19'. The hitch pin retainer or hitch pin 37 is inserted through the aperture 39 in the projecting element 36 to maintain the retaining element 33 in its retaining position. The elongated rod 35 is below the spaced arms 42 of the push beam 38 when the connecting pins 50 are at their forward-most positions against the forward edges 28 of the mounting tabs 19 and 19' as shown in FIG. 5. As long as the plow vehicle is driven in a forward direction, each pin 50 is urged forwardly and remains in contact with its respective forward edge 28. The pins 50 remain in this position as long as the plow vehicle is being driven in a forward direction to push to the plow. When the plow vehicle is driven in reverse, the rear end of the A-frame has a tendency to drop and the rearward motion of the plow vehicle causes each pin 50 to engage the rearward edge 27 of the slot 26. The plow can either be dragged along the ground for pulling snow in restricted locations or lifted from the ground so that the plow can be backed away in preparation for another forward sweep. If, for any reason, the pin 50 moves forwardly and downwardly toward the opening 24, the bottom edges of the arms 42 strike the elongated rod 35 so that the pins 50 are prevented from reaching their respective openings 24. As long as the retaining element 33 is in place, uncoupling of the plow is impossible.

The plow is uncoupled from the plow vehicle by lowering the supporting frame 12 onto supporting blocks so that the pins 50 are more or less aligned with the openings 24. The hitch pin 37 is removed from the projecting element 36 of the retaining element 33 to enable the retaining element.to be removed from the mounting tabs 19 and 19'. The lifting and carrying chains are unhitched from the head gear 25 of the vehicle. The hydraulic lines 16 are disconnected from the vehicle and the vehicle is backed away from the supporting frame 12. The connecting pins 50 exit the slots 26 through the openings 24 as the plow vehicle backs away from the plow frame.

FIRST MODIFIED MOUNTING TAB

Referring to FIGS. 6–8, there is shown a first modified mounting tab which is generally indicated by the reference numeral 67. The mounting tab 67 is similar to the mounting tabs 19 and 19' with respect to the rear portions of the tab. The tab 67 comprises a flat plate 68 which has an opening 72 in the rear edge 70 of the plate. A slot 73 extends forwardly and upwardly from the opening 72 and terminate in a forward edge 74. The slot 73 has an upwardly-extending portion 75 which has a rearward edge 76. The slot 73 is defined, in part, by a lower edge 78. The forward end of the mounting tab 67 has a pair of spaced holes 82 which are adapted to be aligned with the upper and lower apertures 54 of a conventional mounting tab 52 which is fixed to the extending arm 18 of a conventional plow frame. The conventional mounting plate 52 has three holes 54, as shown in FIG. 6. The mounting tabs 67 has a rearward aperture 79 which is below the slot 73 and a forward aperture 80 which is between the mounting holes 82. When the forward end of the mounting tab 67 is placed against the mounting tab 52 in an overlapping relationship, the holes 82 are axially aligned with the upper holes 54 of the tabs 52 and the rearward aperture 80 is axially aligned with the middle hole 54 of the tab 52. The mounting tab 67 is attached to the conventional tab 52 by fastening means, such as bolts 81 which are inserted through the holes 82 and 54 and locked in place by nuts 83. When the mounting tabs 67 are fastened to the conventional tab 54, it functions in the same manner as the tabs 19 and 19' for receiving the pins 50 of the push beam 38, as shown in FIG. 7. When the pin 50 reaches the forward edge 74 of the slot 73, a retaining element which is generally indicated by the reference numeral 84, is applied to the mounting tab 67, as shown in FIGS. 7 and 8. The retaining element 84 is similar to the retaining element 33 and comprises an elongated rod 85 which is inserted through the aperture 79 of the mounting tab 67 at one end of the plow frame and through the aperture 79 of the mounting tab 67 which is located at the opposite end of the plow frame, as shown in FIG. 8. One end of the retaining element 84 has a 180° bend so as to form a retaining element 86 which is substantially parallel with the elongated rod 85. When the elongated rod 85 is inserted through the aperture 79 of the mounting tabs 67, the projecting element 86 is inserted through the forward aperture 80 of the plate 68 and the central mounting hole 54 of the tab 52. A retaining element 84 is retained in this position by inserting a hitch pin retainer 88 through an aperture (not shown) in the projecting element 86 in the same manner as the hitch pin retainer 37 is used to retain the retaining element 33, as shown in FIG. 4. The retaining element 84 functions in the same manner as the retaining element 33 by blocking the descent of the arm 42 and preventing the pins 50 from reaching the openings 72 of the slots 73.

SECOND MODIFIED MOUNTING TAB

Figure 9:
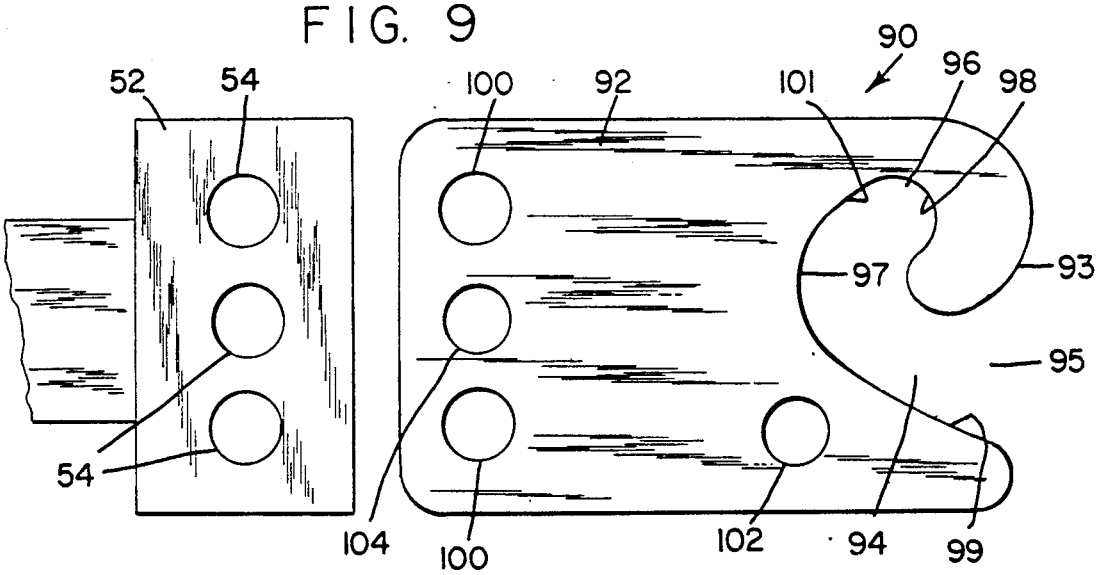
FIG. 9 is a view similar to FIG. 6 showing a second modified mounting tab of the present invention.

Referring to FIG. 9, there is shown a second modified mounting tab which is generally indicated by the reference numeral 90. A mounting tab 90 comprises a flat plate 92 which has an opening 95 in the rear edge 93 of the plate. A first slot 94 extends forwardly and upwardly from the opening 95 and terminates in a forward edge 97. A second slot 96 extends rearwardly and upwardly from the forward edge 28 and terminates in a rearward edge 98. The first slot is defined, in part, by a lower edge 99 and the second slot 96 is defined, in part, by an upper edge 101. The edges 99 and 101 are connected by the forward edge 97. The forward end of the plate 92 has a pair of upper and lower spaced mounting holes 100 which are aligned with the upper and lower mounting holes 54 of the conventional plow frame tab 52 when the forward end of the plate 92 is placed against the tab 52. The plate 92 also has a rearward aperture 102 which is comparable to the aperture 79 of the mounting tab 67 and a forward aperture 104 between the mounting holes 100 which is comparable to the forward aperture 80 of the mounting tabs 67. The mounting tab 97 is fastened to the plow frame tab 52 in the same manner as the mounting tab 67 and retained in the same manner as the tab 67 by the retaining element 84. The rearward aperture 102 receives the elongated rod portion 85 of the retaining element 84 and the forward aperture 104 receives the projecting element 86. After the coupling tab 90 has been applied to the mounting tab 52 at each end of the plow frame and the coupling tabs have been coupled to the push beam 38 so that the pins 50 lie against the forward edges 97 of the coupling tabs. The retaining element is supplied to the coupling tabs in the same manner as for the coupling tab 67, as shown in FIG. 7. The configurations of the slots 94 and 96 are comparable to the first and second slots of the mounting tab which is shown in the above described U.S. patent of Knowlton and function in the same manner. However, the retaining element 84 represents an absolute insurance against uncoupling of the coupling tabs 90 under unusual circumstances.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A coupling for a plow comprising:

(a) a push beam which is attachable to the front of a plow pushing vehicle, said push beam having at least one forwardly-extending arm at each end of the beam and a horizontal connecting pin for each arm which extends transversely of the arm, each of said arms having a bottom edge, (b) a supporting frame which is attachable to the back side of a plow, said frame having a pair of rearwardly extending arms, (c) a vertical mounting tab which is rigidly attached to the rearward end of each of said rearwardly-extending arms, said tab having a rear edge, an opening at said rear edge for receiving the corresponding one of said connecting pins, said opening continuing into a slot which extends upwardly and forwardly from said opening and which terminates in a forward edge, said slot enabling said connecting pin to travel from said opening to said forward edge as said push beam is moved toward said plow, each of said tabs having an aperture which is below said slot and forward of said opening, and (d) an elongated bar which is removably mounted in said apertures so that when the bar is mounted in said apertures when said connecting pins are positioned in said slots, the bar is located directly below the bottom edges of said forwardly-extending arms so that the bar will be struck by said bottom edges when said connecting pins move rearwardly along said slots towards said openings, thereby preventing said pins from reaching said openings.

2. A coupling as recited in claim 1, wherein said bar extends freely through the apertures in said tabs and, wherein said coupling comprises latching means for releasably connecting at least one end of said bar to at least one of said tabs.

3. A coupling as recited in claim 2, wherein said latching means comprises:

(a) a hole in on of said tabs which is spaced from the aperture in said one tab, (b) a projecting element which is fixed to and spaced from the bar and which extends through the hole in said one tab. and (c) a removable connector for retaining said projecting element in said hole and thereby preventing said bar from being removed from said aperture of said tabs.

4. A coupling for a plow and plow vehicle in which the plow is mounted on a supporting frame which has a pair of rearwardly-extending arms and in which the plow vehicle has a push beam which is attached to the front of the vehicle, said push beam having at least one forwardly-extending arm at each end of the beam and a horizontal connecting pin for each arm which extends transversely of the arm, each of said arms having a bottom edge, said coupling comprising:

(a) a vertical mounting tab which is rigidly attachable to the rearward end of each of said rearwardly-extending arms, said tab having a rear edge, an opening at said rear edge for receiving the corresponding one of said connecting pins, said opening continuing into a slot which extends upwardly and forwardly from said opening and which terminates in a forward edge, said slot enabling said connecting pin to travel from said opening to said forward edge, as said push beam is moved toward said plow, each of said tabs having an aperture which is below said slot and forward of said opening, and (b) an elongated bar which is removably mounted in said apertures so that when the bar is mounted in said apertures, when said pins are positioned in said slots, the bar is located directly below the bottom edges of said forwardly-extending arms so that the bar will be struck by said bottom edges when said corresponding pins move rearwardly along said slots towards said openings, thereby preventing said pins from reaching said openings.

5. A coupling as recited in claim 4, wherein said bar extends freely through the apertures in said tabs and, wherein said coupling comprises latching means for releasably connecting at least one end of said bar to at least one of said tabs.

6. A coupling as recited in claim 5, wherein said latching means comprises:

(a) a hole in one of said tabs which is spaced from the aperture in said one tab, (b) a projecting element which is fixed to and spaced from the bar and which extends through the hole in said one tab, and (c) a removable connector for retaining said projecting element in said hole and thereby preventing said bar from being removed from said tab.

* * * * *